United States Patent [19]

Sauer

[11] Patent Number: 4,531,340

[45] Date of Patent: Jul. 30, 1985

[54] BEAM SPLICE FOR SUPPORTING GRID SYSTEMS

[75] Inventor: Gale E. Sauer, Williamsville, N.Y.

[73] Assignee: Donn Incorporated, Westlake, Ohio

[21] Appl. No.: 411,043

[22] Filed: Aug. 24, 1982

[51] Int. Cl.[3] ..... E04C 3/04

[52] U.S. Cl. ..... 52/726; 403/393

[58] Field of Search ..... 52/726, 664, 666, 667, 52/484, 485, DIG. 5; 403/340, 346, 347, 393

[56] References Cited

U.S. PATENT DOCUMENTS

| | | | |
|---|---|---|---|
| 2,281,109 | 4/1942 | Olsen | 52/485 |
| 2,840,200 | 6/1958 | Wong | 403/347 |
| 3,093,221 | 6/1963 | Purdy | 52/484 |
| 3,221,466 | 12/1965 | Downing, Jr. et al. | 52/726 |
| 3,221,846 | 12/1965 | Brown et al. | 52/DIG. 5 |
| 3,239,035 | 3/1966 | Znamirowski | 52/667 |
| 3,284,977 | 11/1966 | Lickliter et al. | 52/DIG. 5 |
| 3,297,345 | 1/1967 | Downing, Jr. | 403/326 |
| 3,399,915 | 9/1968 | Stanzak | 52/726 |
| 3,501,185 | 3/1970 | Brown et al. | 52/664 |
| 3,898,784 | 8/1975 | Sauer et al. | 403/393 |
| 3,921,363 | 11/1975 | Beynon | 403/219 |
| 3,928,950 | 12/1975 | Beynon | 403/393 |
| 3,979,874 | 9/1976 | Cubbler, Jr. et al. | 52/484 |
| 4,108,563 | 8/1978 | Brown et al. | 52/667 |
| 4,161,856 | 7/1979 | Brown et al. | 52/726 |
| 4,317,318 | 3/1982 | Sauer | 52/726 |
| 4,317,641 | 3/1982 | Sauer | 52/667 |
| 4,389,828 | 6/1983 | Cary | 52/726 |
| 4,462,198 | 7/1984 | Sharp | 52/667 |
| 4,484,428 | 11/1984 | Sauer | 52/311 |

*Primary Examiner*—John E. Murtagh
*Assistant Examiner*—Andrew Joseph Rudy
*Attorney, Agent, or Firm*—Christel, Bean & Linihan

[57] ABSTRACT

A beam member for use in a suspended ceiling system for retaining removable panel sections includes at each longitudinal end an integral tongue and a tongue-receiving recess for joining the beam member in end-to-end relationship with another beam member having an end of corresponding configuration. The tongue is characterized by inwardly diverging sidewalls, and an outwardly offset and a rearwardly extending detent. The detent has an edge defining a circular arc, and the recess includes an arcuate central portion for abutting the edge of the arcuate detent of another beam member when the beam members are joined and outwardly diverging sidewalls. Interlocked tongues of such configuration are capable of withstanding large tensile separating forces.

9 Claims, 4 Drawing Figures

Fig. 1.
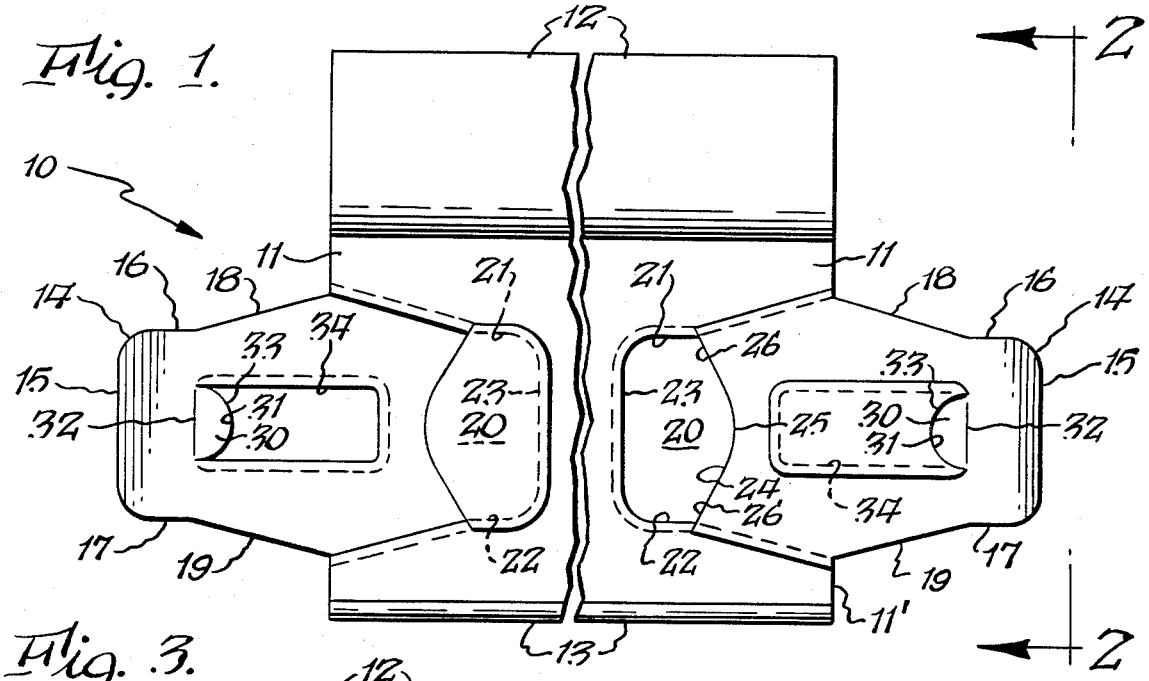
Fig. 3.
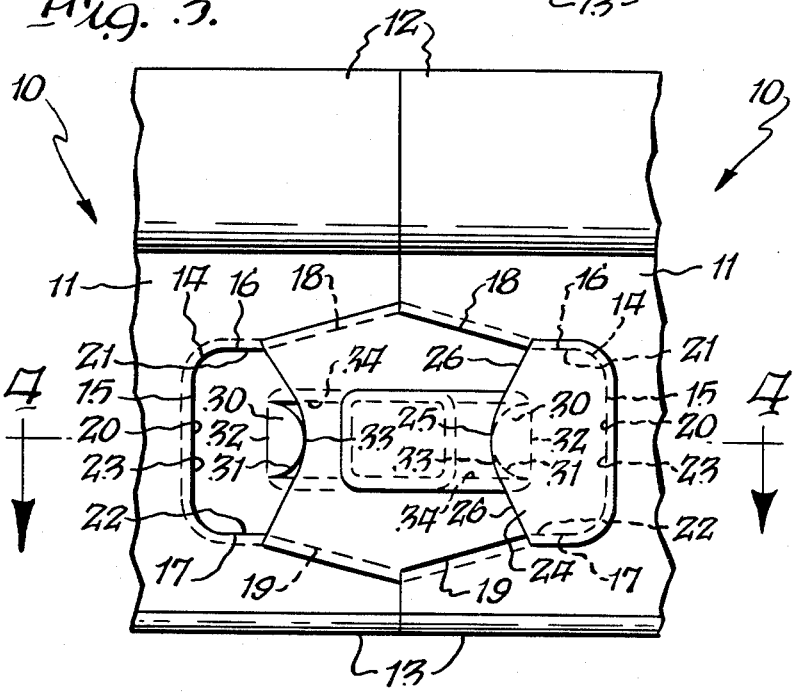
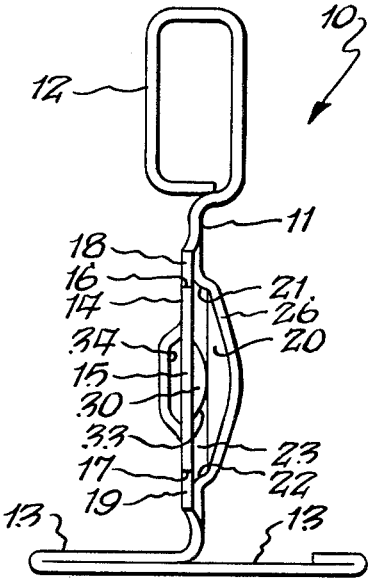
Fig. 2.
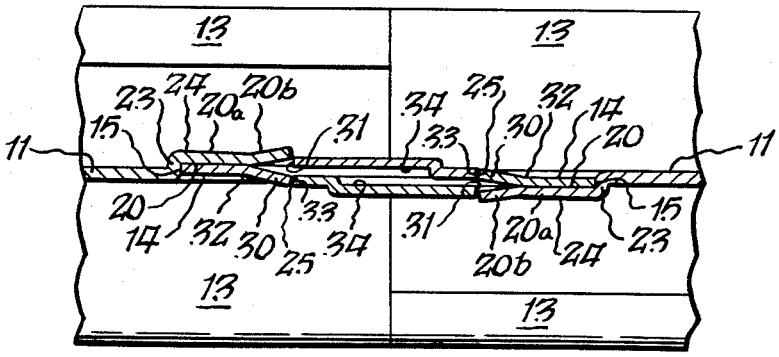
Fig. 4.

BEAM SPLICE FOR SUPPORTING GRID SYSTEMS

BACKGROUND OF THE INVENTION

This invention relates to beams utilized in supporting grid systems for suspended ceilings, and more particularly to an improved splice for interconnecting adjacent beam members in end-to-end relation and having increased pull-apart resistance.

In the process of erecting suspended ceiling systems and the like, beam members having outwardly directed, panel supporting flanges are arranged in a square or rectangular intersecting pattern to provide surfaces upon which the ceiling panels may be positioned. The beam members are most frequently of a length less than the length of the total span involved, and thus must be interconnected with adjacent beam members to provide a continuous beam which spans a pair of opposed walls within the structure in which the suspended ceiling system is installed.

One of the desirable features of the structure utilized to interconnect a series of adjacent beam members is that the interconnection be effected rapidly and securely, so that subsequent forces to which the system is subjected do not cause disconnection of the beam members at the points of joinder. Thus it is desirable that the ends of the adjacent beam members which are joined are of such a construction that tensile forces tending to separate the beam members longitudinally be resisted to the greatest degree practicable. In fact, local building code changes in various parts of the country in the last several years have imposed increased pull-apart load minimums because of seismic factors.

One way in which to prevent unwanted separation of beam members joined in end-to-end relation is to provide an axially arranged, outwardly extending tongue and detent arrangement on the ends of the beam members to permit interlocking connection with similarly configured adjacent beam members, the detents being engageable against abutment walls formed in the beam members so that the ends of the beam members are tightly interconnected and not readily axially separable. The detent engaging abutment walls of commercially available structures of this type usually are straight edges extending perpendicularly to the tile supporting flanges. It has been found that such straight edge constructions do not meet some of the pull-apart resistance requirements now in effect. Thus, it is desirable to provide an improved interconnection arrangement which is capable of sustaining substantially higher tensile loads.

It is an object of the present invention to provide such an improved interconnecting beam structure which is capable when assembled of withstanding significantly higher tensile separating forces than the prior art devices, and which also is capable of quick and easy initial assembly.

BRIEF SUMMARY OF THE INVENTION

Briefly stated, in accordance with one aspect of the present invention, a beam member for use with a suspended ceiling system incorporating removable panel sections is provided and includes an elongated, upstanding web portion, a transverse flange extending outwardly from the web portion to peripherally support the panel sections, and a longitudinal reinforcing element disposed along the web portion. At each of the longitudinal ends of the beam member an outwardly extending tongue is provided which projects from the web portion and is integral therewith. The tongue includes an outwardly offset, rearwardly extending detent which is struck therefrom and which terminates in an arcuate leading edge. Longitudinally inwardly of the detent an abutment wall is provided in the web portion when forming a recess, the abutment wall having an arcuate central portion and sidewalls which diverge rearwardly from the tongue.

BRIEF DESCRIPTION OF THE DRAWING

FIG. 1 is a side elevational view of a beam member, partially broken away, illustrating the structural arrangement at the longitudinal ends thereof.

FIG. 2 is an end elevational view taken along the line 2—2 of FIG. 1.

FIG. 3 is a fragmentary side elevational view showing the ends of a pair of beam members in accordance with the present invention which have been interconnected.

FIG. 4 is a longitudinal cross-sectional view of the interconnection of the beams of FIG. 3, taken along the line 4—4 thereof.

DESCRIPTION OF THE ILLUSTRATED EMBODIMENT

Referring now to the drawing, and particularly to FIGS. 1 and 2 thereof, there is shown the respective longitudinal ends of a beam member 10 suitable for use with suspended ceiling systems, the portion of the beam member intermediate the ends being broken away for convenience of illustration. It is to be understood that beam member 10 can be of any convenient length. Beam member 10 includes a longitudinal, upstanding web portion 11, which includes a reinforcing channel 12 along its upper edge, and which also includes a pair of oppositely extending, outwardly directed flanges 13 along the lower edge of web 11. Flanges 13 are substantially coplanar and are preferably so oriented that they are perpendicular to the plane of web portion 11. Reinforcing channel 12 shown is of generally rectangular cross section, although circular or other reinforcing channel cross sections cold be used instead, if desired.

As best seen in FIG. 1, web portion 11 includes an axially outwardly extending tongue 14 having a flat leading edge 15 which is spaced outwardly from web 11, and flat generally parallel upper and lower forward tongue edges 16 and 17, respectively. Leading edge 15 is substantially perpendicular to edges 16 and 17, with rounded corners at the intersections of edge 15 and edges 16 and 17. However, the precise shape of the forwardmost section of tongue 14 is not critical, and any convenient or desired configuration can be utilized. Extending rearwardly from upper and lower tongue edges 16 and 17, respectively, toward web 11 are tongue edges 18 and 19, respectively, which diverge and which join upper and lower tongue edges 16 and 17, respectively, with web 11. Tongue 14 is laterally offset with respect to the plane in which web 11 is positioned, so that adjacent beams 10 can be assembled in substantially coaxial longitudinal form with the respective flanges 13 thereof substantially coplanar, as will hereinafter be described in more detail.

Positioned inwardly both of tongue leading edge 15 and of the outermost edge 11' of web portion 11 is a substantially planar recess 20, which extends laterally outwardly from web 11 on the opposite side thereof from tongue 14, to thereby define a pocket for receiving the forwardmost portion of the tongue 14 of the adjacent beam member which is to be joined to beam 10. Thus recess 20 should be so configured as to receive the forward portion of the tongue 14 of the adjacent beam, and the recess shown in the drawing is defined by generally parallel upper and lower sidewalls 21 and 22, respectively, and an inner end wall 23 substantially perpendicular to upper and lower sidewalls 21 and 22, respectively, corresponding to tongue edges 16, 17 and 15, respectively. Recess 20 is formed by laterally outwardly displacing a portion of web 11 and simultaneously cutting through web 11 at the forward end of the recess to provide an axially disposed entryway to the recess thereby formed. It is a particular feature of this invention that the edge of web 11 which is exposed by cutting the web to provide entry to recess 20 longitudinally thereof defines an abutment wall 24 having an arcuate central portion 25 and outwardly diverging, substantially linear sidewalls 26. Preferably, arcuate central portion 25 is defined by a circular arc, and outwardly diverging sidewalls 26 are preferably tangential thereto to provide a smooth, substantially continuous surface up to the intersection of abutment wall 24 with the upper and lower walls 21, 22 of recess 20. The points of intersection are connected to the points where the tongue edges 16, 17 intersect with the end 11' of the beam member, the entire tongue structure being laterally displaced from the web a distance corresponding approximately one-half the thickness of the material defining the web 11 of the adjacent beam member.

Tongue 14 also includes a detent 30 formed in the outer portion thereof by making an arcute cut 31 therein and displacing the material thereof outwardly about a bend line 32 so that detent 30 extends at an acute angle from the plane defined by tongue 14. Detent 30 extends outwardly from the same side of the tongue as recess 20 extends from web 11. Edge 33 of detent 30 is preferably a circular arc, the radius of which is preferably substantially equal to the radius of curvature of arcuate central portion 25 of abutment wall 24 for greater surface contact therebetween when adjacent beam members are assembled in interlocking relationship. As can clearly be seen from the drawings, the center of curvature for the curved leading edge 33 of the detent lies longitudinally outwardly of the edge 33 with respect to an end of the web portion, and similarly, the center of curvature for the curved central portion 25 lies longitudinally inwardly of the curved central portion. Although shown as of generally semi-circular construction, detent 30 can be of any convenient arcuate shape, as desired.

Tongue 14 incorporates an integral recess 34 which extends from detent 30 rearwardly along tongue 14 to a point outwardly or forwardly of abutment wall 24. Recess 34 is offset laterally on the opposite side of tongue 14 from which detent 30 extends, and serves to facilitate assembly of adjacent beam members by permitting the detent of the adjacent beam member to pass freely longitudinally along the tongue, as will hereinafter be described.

As best seen in FIG. 4, the forward, outer edge of sidewall **20*a* of pocket 20 includes a blunt, outwardly extending lip 20*b*, which is disposed at an acute angle to sidewall 20*a* to facilitate guiding the tongue of the adjacent beam member into recess 20**.

The beam end structure as hereinabove described is provided at each end of beam 10, with tongue 14 at each respective end being laterally displaced on the opposite side of web 11 from the tongue 14 at the opposite end so that the tongues of adjacent beams slide with respect to each other when the beams are assembled, and so that the longitudinal axes of the assembled beams are coincident. Assembly is effected by axially sliding tongues 14 of the two adjacent beam members 10 over each other so that the respective forward portions 15, 16 and 17 thereof are received in the pockets defined by the respective recesses 20. Detents 30 resiliently yield to permit this, and snap through the recess openings 20 for axial engagement with abutment walls 24. When brought together in interengaging relationship, detent 30 of the respective beam members will bear against abutment wall 24 of the adjacent beam member, and to provide increased resistance to axial tensile forces.

With the beam end structure hereinabove shown and described, it has been found that the resistance to separation of joined beam elements in currently available grid configurations is in the range of from about 300 to about 400 pounds tensile load when provided in a typical present day, commercial configuration. For a beam end structure of the type having a straight abutment edge, when provided in the same commercial material thickness, the joinder of two adjacent beams has been found to fail under a tensile load of approximately 225 lbs. Thus the structure of the present invention provides a significant improvement with respect to pull-apart resistance, on the order of about 33% or more. Although the precise reasons why such improved pull-apart resistance is obtained are not exactly known, it is thought to be due in part to the increased area of surface contact between the arcuate detent edge 33 and the arcuate central portion 25 of abutment wall 24, distributing the stress over a greater cross-sectional area adjacent the web edge, and especially to the strengthening effect of the additional web material behind the inclined, outwardly diverging side portions 26 of abutment wall 24. This additional material, positioned axially inwardly of the abutment wall portion 25 engaged by detent edge 33, adds a tension component of resistance to the compression resistance offered by the web material immediately behind the central portion 25.

It is another feature of this invention that the flared tongue construction provided by the rearwardly diverging upper and lower tongue edge portions 18, 19 which join the forwardmost tongue section 15, 16, 17 to the outer edge 11' of web 11 greatly strengthen the tongue against transverse buckling, as compared with typical tongue constructions having generally parallel upper and lower edges throughout. This also is important in providing a supporting grid system capable of resisting more extreme disruptive forces.

While a particular embodiment of the present invention has been illustrated and described, it will be apparent to those skilled in the art that various changes and modifications can be made without departing from the spirit and scope of the present invention, and that the splice of this invention is not limited to use with the type of T section beam member shown but also can be used, for example, with beam members having web portions of laterally spaced double wall construction. It is intended to cover in the appended claims all such changes and modifications that fall within the scope of the present invention.

What is claimed is:

1. In a beam member for use with a suspended ceiling system for retaining removable panel sections, said beam member including a longitudinally extending, upstanding web portion, a transverse flange extending outwardly from a lower edge of said web portion to peripherally support said panel sections, the improvement comprising a tongue which extends longitudinally outwardly from an end of said web portion and integral therewith, said tongue having a laterally offset detent provided with an inwardly extending curved leading edge, the center of curvature for said curved leading edge lying longitudinally outwardly of said leading edge, and the web portion being provided with an abutment wall spaced longitudinally inwardly of said tongue, said abutment wall having a curved central portion and vertically spaced apart diverging sidewalls, the center of curvature for said curved central portion lying longitudinally inwardly of said central portion, said curved central portion being capable of receiving in nesting relationship the curved leading edge of a detent of another beam member when disposed in end to end relation.

2. The beam member of claim 1 wherein said sidewalls of said abutment wall are linear and extend tangentially from said arcuate central portion.

3. The beam member of claim 1 wherein said beam member includes a longitudinal recess extending rearwardly of said detent and laterally outwardly of said tongue on the side opposite said detent.

4. The beam member of claim 1, wherein said tongue has a forwardmost section joined to said web portion by axially inwardly diverging upper and lower tongue edge portions.

5. The beam member of claim 4, wherein said forwardmost section of said tongue has a leading edge and generally parallel upper and lower forward edges extending from said leading edge to said diverging upper and lower tongue edge portions.

6. A beam splice for interconnecting one beam member to an adjacent beam member in end to end relation, each beam member including a longitudinally extending web which is adapted to lie in a vertical plane, the web having upper, lower and end edges, each beam member further including a transverse flange extending outwardly from the lower edge of said web to peripherally support panel sections, there being beam splice at adjacent end portion of each of said beam members; each beam splice comprising:

an abutment wall spaced inwardly of the associated end edge of the web, the abutment wall including a curved central portion and vertically spaced apart diverging sidewalls, the center of curvature for said central portion lying longitudinally inwardly of said central portion;

a first portion of the web extending longitudinally inwardly from a location immediately adjacent said abutment wall, said first portion being laterally offset to one side of the place of said web to define a pocket;

a tongue extending longitudinally outwardly of the end edge of the web, the tongue being integral with the web and laterally offset to the other side of the plane of the web;

a second portion of the web extending longitudinally outwardly from the abutment wall to the tongue, said second portion being laterally offset to said other side of the plane of the web an amount equal to the lateral offset of said tongue;

a detent in said tongue, the detent being provided with a curved leading edge which is laterally offset to said one side, the center of curvature for said curved leading edge lying longitudinally outwardly of said leading edge;

the parts being so arranged and constructed that the curved central portion of one beam member is capable of receiving in nesting relationship the curved leading edge of a detent of an adjacent beam member when said beam splice is interconnecting one beam member to an adjacent beam member.

7. The beam splice as set forth in claim 6 wherein said tongue has a forwardmost section joined to said web by axially inwardly diverging upper and lower tongue edge portions.

8. The beam splice as set forth in claim 7 wherein the second portion of the web extending between the abutment wall and the tongue is defined by axially outwardly diverging upper and lower edge portions.

9. The beam splice as set forth in claim 6 wherein the curved central portion and the curved leading edge are disposed substantially equal distances away from the end edge of the web whereby when said beam splice is interconnecting one beam member to an adjacent beam member the end edge of the web of one beam member will contact the end edge of the web of an adjacent beam member.

* * * * *